US011080966B2

(12) United States Patent
Merati

(10) Patent No.: US 11,080,966 B2
(45) Date of Patent: Aug. 3, 2021

(54) DUAL-METER HYBRID GAMING APPARATUS, SYSTEM AND METHOD

(71) Applicant: UPLAY1, San Diego, CA (US)

(72) Inventor: Bruce Merati, San Diego, CA (US)

(73) Assignee: Uplay1, Las Vegas, NV (US)

( * ) Notice: Subject to any disclaimer, the term of this patent is extended or adjusted under 35 U.S.C. 154(b) by 536 days.

(21) Appl. No.: 15/424,314

(22) Filed: Feb. 3, 2017

(65) Prior Publication Data

US 2017/0330420 A1 Nov. 16, 2017

Related U.S. Application Data

(60) Provisional application No. 62/336,516, filed on May 13, 2016.

(51) Int. Cl.
*G07F 17/32* (2006.01)

(52) U.S. Cl.
CPC ..... *G07F 17/3262* (2013.01); *G07F 17/3237* (2013.01); *G07F 17/3244* (2013.01); *G07F 17/3258* (2013.01); *G07F 17/3288* (2013.01); *G07F 17/3295* (2013.01)

(58) Field of Classification Search
CPC ..... G07F 17/3262; G07F 17/3258; G07F 17/3288; G07F 17/3295
See application file for complete search history.

(56) References Cited

U.S. PATENT DOCUMENTS 4,582,324 A * 4/1986 Koza ..... A63F 13/12 463/16
5,280,909 A * 1/1994 Tracy ..... G07F 17/32 463/27
5,286,023 A * 2/1994 Wood ..... A63F 3/081 463/20
5,292,127 A * 3/1994 Kelly ..... A63F 7/0058 273/118 A
5,318,298 A * 6/1994 Kelly ..... A63F 7/0058 273/118 A
5,344,144 A * 9/1994 Canon ..... A63F 3/081 273/143 R
5,401,023 A * 3/1995 Wood ..... G06F 17/18 463/13
5,816,918 A * 10/1998 Kelly ..... A63F 3/081 463/16
5,951,011 A * 9/1999 Potter ..... A63F 3/00157 273/292
6,050,895 A * 4/2000 Luciano, Jr. ..... G07F 17/32 463/20
6,174,237 B1 * 1/2001 Stephenson ..... A63F 13/12 463/42
6,267,669 B1 * 7/2001 Luciano, Jr. ..... A63F 13/10 463/7
6,290,603 B1 * 9/2001 Luciano, Jr. ..... G07F 17/3244 463/25

(Continued)

*Primary Examiner* — Omkar A Deodhar
*Assistant Examiner* — Matthew D Hoel
(74) *Attorney, Agent, or Firm* — Thibault Patent Group

(57) ABSTRACT

A variety of embodiments are described for determining two or more game payouts in a game based on both skill and chance. In one embodiment, a gaming device or gaming server determines a skill level of a player as the player plays a game, and then determines a chance payout based on a random number generator and a skill payout based on the skill level of the player.

16 Claims, 14 Drawing Sheets

(56) References Cited

U.S. PATENT DOCUMENTS 6,325,375 B1 * 12/2001 Potter ..... A63F 3/00157 273/292
7,175,524 B2 * 2/2007 Bansemer ..... A63F 9/0291 463/16
7,958,021 B2 * 6/2011 Schoonmaker ..... G07F 17/3234 705/30
8,025,564 B2 * 9/2011 Jackson ..... G07F 17/3258 463/20
8,033,912 B2 * 10/2011 Cannon ..... G07F 17/3244 463/25
8,070,576 B2 * 12/2011 Bennett ..... G07F 17/3211 463/16
8,157,648 B2 * 4/2012 Green ..... G07F 17/3223 463/29
8,337,300 B2 * 12/2012 Bowers ..... G07F 17/3267 463/25
8,398,475 B2 * 3/2013 De Waal ..... G07F 17/3267 463/16
8,602,881 B2 * 12/2013 Arnone ..... G07F 17/3227 463/25
8,657,660 B2 * 2/2014 Arnone ..... G07F 17/3295 463/16
8,715,068 B2 * 5/2014 Arnone ..... G07F 17/3244 463/25
8,715,069 B2 * 5/2014 Arnone ..... G07F 17/3211 463/25
8,758,122 B2 * 6/2014 Arnone ..... G07F 17/3262 463/25
8,817,408 B2 * 8/2014 Lockton ..... A63F 13/795 360/65
8,821,264 B2 * 9/2014 Arnone ..... G07F 17/34 463/25
8,834,263 B2 * 9/2014 Arnone ..... G07F 17/3258 463/25
8,851,967 B2 * 10/2014 Arnone ..... A63F 9/24 463/16
8,992,297 B2 * 3/2015 De Waal ..... G07F 17/3248 463/16
8,998,707 B2 * 4/2015 Arnone ..... G07F 17/3262 463/25
9,047,735 B2 * 6/2015 Arnone ..... G07F 17/3279
9,251,657 B2 * 2/2016 Arnone ..... G07F 17/32
9,489,797 B2 * 11/2016 Arnone ..... G07F 17/34
9,542,799 B2 * 1/2017 Washington ..... G07F 17/32
9,811,968 B1 * 11/2017 Odom ..... G07F 17/3211
10,078,939 B2 * 9/2018 Frenkel ..... G07F 17/3209
10,089,823 B2 * 10/2018 Frenkel ..... G07F 17/3293
10,311,679 B2 * 6/2019 Washington ..... A63F 13/352
10,453,309 B1 * 10/2019 Liss ..... G07F 17/3255
10,733,837 B2 * 8/2020 Lancaster ..... G07F 17/3262
10,885,739 B2 * 1/2021 Arnone ..... G07F 17/32
2002/0055379 A1 * 5/2002 Saidakovsky ..... G07F 17/3262 463/9
2002/0160825 A1 * 10/2002 Nicastro ..... G07F 17/32 463/16
2003/0109301 A1 * 6/2003 Chudley ..... A63F 13/798 463/23
2003/0119576 A1 * 6/2003 McClintic ..... G07F 17/32 463/20
2003/0218303 A1 * 11/2003 Walker ..... A63F 1/00 273/292
2004/0048644 A1 * 3/2004 Gerrard ..... G07F 17/3244 463/16
2006/0030400 A1 * 2/2006 Mathis ..... G07F 17/32 463/20
2008/0064458 A1 * 3/2008 Yang ..... A63F 13/00 463/7
2008/0108401 A1 * 5/2008 Baerlocher ..... G07F 17/32 463/12
2008/0146322 A1 * 6/2008 Hardy ..... G07F 17/32 463/25
2008/0153570 A1 * 6/2008 Esses ..... G07F 17/3244 463/20
2011/0009178 A1 * 1/2011 Gerson ..... G07F 17/3295 463/17
2011/0212766 A1 * 9/2011 Bowers ..... G07F 17/3244 463/25
2012/0094733 A1 * 4/2012 Kane ..... G07F 17/32 463/16
2013/0178273 A1 * 7/2013 De Waal ..... G07F 17/32 463/20
2014/0080559 A1 * 3/2014 Knutsson ..... G07F 17/32 463/10
2014/0087844 A1 * 3/2014 Gilliland ..... G07F 17/3267 463/25
2014/0228086 A1 * 8/2014 Smith ..... G07F 17/326 463/7
2014/0309002 A1 * 10/2014 O'Gorman ..... G07F 17/3267 463/7
2015/0024829 A1 * 1/2015 Arnone ..... G07F 17/3295 463/23
2015/0161847 A1 * 6/2015 Arnone ..... G07F 17/3244 463/25
2015/0187184 A1 * 7/2015 De Waal ..... G07F 17/3286 463/20
2015/0294536 A1 * 10/2015 Arnone ..... G07F 17/3262 463/16
2015/0317874 A1 * 11/2015 Arnone ..... G07F 17/3295 463/16
2016/0171835 A1 * 6/2016 Washington ..... A63F 13/822 463/25
2017/0084124 A1 * 3/2017 Brunet de Courssou ..... G07F 17/3267
2017/0084129 A1 * 3/2017 Baerlocher ..... G07F 17/3258

* cited by examiner

Player Deposits $100

| Balance | Wager | Win | | |
|---|---|---|---|---|
| | | Total | Chance | Skill |
| $100 | | | | |
| 108 | 110 | 112 | 114 | 116 |

Fig. 6a

Player Wagers $10

| Balance | Wager | Win | | |
|---|---|---|---|---|
| | | Total | Chance | Skill |
| $90 | $10 | | | |
| 108 | 110 | 112 | 114 | 116 |

Fig. 6b

Player does not Win

| Balance | Wager | Win | | |
|---|---|---|---|---|
| | | Total | Chance | Skill |
| $90 | | | | |
| 108 | 110 | 112 | 114 | 116 |

Fig. 6c

Player Wins, both for Skill and on Chance

| Balance | Wager | Win | | |
|---|---|---|---|---|
| | | Total | Chance | Skill |
| $145 | | $55 | $54 | $1 |

FIG. 6d

Player Wins for Skill

| Balance | Wager | Win | | |
|---|---|---|---|---|
| | | Total | Chance | Skill |
| $91 | | $1 | | $1 |

FIG. 6e

Player Wins on Chance

| Balance | Wager | Win | | |
|---|---|---|---|---|
| | | Total | Chance | Skill |
| $315 | | $225 | $225 | |

FIG. 6f

5-Card Draw Poker - Jacks or Better

Paytable

| HAND | PAYOUT |
|---|---|
| Royal Flush | 500 |
| Straight Flush | 50 |
| Four of a Kind | 25 |
| Full House | 9 |
| Flush | 6 |
| Straight | 4 |
| Three of a Kind | 3 |
| Two Pair | 2 |
| Jacks or Better | 1 |

FIG. 7

Pari-Mutuel Dual-Meter Horse Racing Pools

| | Actual Race | Hybrid Race |
|---|---|---|
| Win | $ | $ |
| Place | $ | $ |
| Show | $ | $ |
| Exacta | $ | $ |
| Quinella | $ | $ |
| Trifecta | $ | $ |
| Superfacta | $ | $ |

FIG. 11

Player Wagers $10

Player Loses

Player Wins

Player Wagers $10

| Balance | Wager | Win | | | Progressive |
|---|---|---|---|---|---|
| | | Total | Chance | Skill | Skill |
| $90 | $10 | | | | $60 |

FIG. 13a

Player Wins $14 on Chance

| Balance | Wager | Win | | | Progressive |
|---|---|---|---|---|---|
| | | Total | Chance | Skill | Skill |
| $104 | | $14 | $14 | | $61 |

FIG. 13b

Player Wins $63 for Skill

| Balance | Wager | Win | | | Progressive |
|---|---|---|---|---|---|
| | | Total | Chance | Skill | Skill |
| $153 | | $63 | | $2 | |

FIG. 13c

DUAL-METER HYBRID GAMING APPARATUS, SYSTEM AND METHOD

CROSS-REFERENCE TO RELATED APPLICATIONS

This application claims the benefit of U.S. provisional patent application No. 62/336,516, filed on May 13, 2016 and incorporated by reference herein.

BACKGROUND

Field of Use

The present application relates to gaming systems and more specifically to electronic gaming systems that are based on chance or skill.

Description of the Related Art

Electronic gaming is a relatively new industry that has enjoyed exponential growth, underpinned by constantly evolving technology innovations. The history of the industry started in the early 1970's when Atari launched Pong, the first commercially successful arcade video game, followed by the casino industry introducing electronic slot machines in the 1980's. With accelerated advancements in technology, faster and cheaper computers, electronic games became more advanced, appealing to a wide demographic of players. Since their introduction, electronic video games have been growing on two distinct paths, each one having its own customer base and business models. On one path, arcade stores have offered skill-based video games, and on a separate path, the gaming industry has introduced video slots that replaced mechanical slot machines. Video games in arcade stores and slot machines in casinos have had different revenue models. Arcade stores rely on a "pay-per-play" model for, while casinos relied on patrons' willingness to play video slots for a chance to win money. As computer technology became cheaper and faster, arcade type games moved to players' homes and slot machines revolutionized the casino industry, generating significant cash flows that paid for the construction of multi-billion dollar mega resorts.

With the diffusion of broadband Internet access, arcade games' pay-per-play model has transitioned to online video games played at home with revenue models that range from retail purchase, subscription fee, pay-per-play to advertising. On the other side of the spectrum, slot machine games have expanded to proliferation of online gaming played either for fun, for real money or on a "pay-per-play' model. Both video gaming and online gaming are rapidly growing multi-billion dollar industries that have jeopardized the business model of their predecessors to the point that the revenues of arcade video games played at arcade stores have already seen substantial declines and land-based casinos have started experiencing a steady decline in their slot machine revenues. Arcade video games and slot machines have grown in their own vertical markets and have yet to converge in any significant way. Land-based casinos and slot manufacturers are now discovering that millennials who have been growing up with action packed video games find their slot games bland and unexciting to play and are now actively looking for a new type of gaming that will appeal to the younger generation.

When playing video games or slot machines, outcomes may be based on different factors. In skill-based games, a player's reaction speed, mental skills such as logic abilities, strategic thinking or trivia knowledge determines the outcome. Examples of such games include chess (purely a mental game), darts (purely a physical game). In games of chance, a mechanical or a computerized random number generator determines the outcome. Examples include most slot machines, ball or number drawn games such as lottery, keno or bingo. Some games combine an element of chance and an element of skill to determine outcomes. For example, poker, bridge or backgammon all have an element of chance but also require mental skills.

The laws and regulations of a jurisdiction generally treat games of chance differently from games of skill, and often the legal distinction between the two is vague and may vary from one jurisdiction to another.

The gaming industry calculates key statistics such as House Edge (HE) and Return to Player (RTP) for games of chance such as keno and slot machines based on probability theories and laws of large numbers. HE is the difference between the wager amount and its theoretical payout, defined as a game's expected payoff using probability theories. In the case of games that are purely based on chance, the actual RTP's and the theoretical RTP's differ but converge over a long period of play. However, this is not necessarily the case for hybrid games such as video poker and blackjack, which also have an element of skill and their true RTP's vary depending on players' skills. Typically, the industry calculates the RTP and the HE for hybrid games based on the assumption that players follow the best strategy. However, the more decisions a player has to make, the more mistakes the player will make, and the less likely it is that the player will achieve the theoretically optimal house advantage.

Arcade-style games are usually action based, designed to be frantic and addictive, focusing on users' reflexes, intellect, thinking, strategy, problem solving skills, or a combination of these skills. Action-based games typically employ physical challenges, and reward exceptional hand-eye coordination and reaction times. These games usually involve fighting or shooting, with the player typically controlling an avatar. With most action-based games, players try to reach a next level by completing certain tasks, such as collecting objects, avoiding obstacles, or battling enemies.

Strategy games, usually emphasize resource acquisition, management, and/or application to achieve an objective. For example, players may accumulate resources, which can be converted to measurable units, which in turn can be converted to other assets, such as factories, that produce more goods. Puzzle games usually emphasize problem-solving skills used to solve puzzles including logic patterns, sequence solving, word completion, etc.

An electronic game may be based on chance, skill or a combination of the two. Skill-based games may have their own sub-categories that are either based on intellect or physics. Sub-categories of games with intellect include math, logic, problem solving, etc. and sub-categories of physics may include those that involve reflexes, speed and coordination. The emergence of online video streaming services have helped the growth of professional video game tournaments, a new phenomenon called eSports that has recently become extremely popular with millennials to play and to watch. Millions of people around the globe are now watching eSports regularly, televised on TV or streamed to media platforms such as Twitch.tv and some punters have even started wagering on eSports. Although wagering on eSports is illegal in most states in the U.S., participation in eSports tournament does not fall under gambling laws and is legal in most jurisdictions as skilled games. The divergence in consumers' tastes, where younger generations prefer skill-based games to games of chance, has created an opportunity for the gaming industry to address this demographic trend.

One of the challenges facing land-based casinos is that as players get more gaming savvy, the number of exciting and challenging games available to them on any given casino floor become limited. Recently, highly regulated gaming states in the U.S., such as Nevada and New Jersey, have adopted regulations for slot games in which players may receive higher payouts based on their skills. These regulations create three distinct game categories: chance-based games, where the outcome of a game is purely based on chance, skill games, where a player's abilities largely govern game outcomes, and hybrid games, where a combination of skill and chance affects game results. The regulations permit pay tables of hybrid games to vary, depending on a player's skill level, and do not allow a gaming device to change its game rules and payouts during the game without prominently notifying the player.

Gaming manufacturers currently offer hybrid games that add skill to bonus rounds of a slot machine. For example, a hybrid game may include a standard slot machine as its base game and a bonus round with skill features that increase the win percentage based on a player's skill. Gaming regulations require the benefit a player receives from the skill component of a hybrid game to be quantifiable. Overall, the industry has several other challenges, one is compliance with regulations such as payout transparency i.e. a game has to clearly display its potential payouts. Another challenge relates to the fairness of a game, such as the RTP of a game not to be less than a given percentage, say 75%. There is also the economic constraint that a game cannot have an RTP of more than 100%, in other words its total payouts in long run, cannot exceed the amounts wagered on the game.

For a game to be approved by a state or an independent gaming lab, its theoretical payouts must meet regulatory standards, payouts must be computable and the game's RTP must be disclosed to players. Traditionally, independent testing labs and regulators calculate the RTP of a slot game that involve decisions, such as video poker or blackjack, with the assumption that a player follows perfect strategy, and since a large majority of players do not, the actual hold percentages of these games often exceed their theoretical house advantage percentages. For example, a 5-card draw video poker that has a theoretical house edge of half of one percent could hold more than 5 percent, yet it has remained a popular casino game, mainly because the chance element of the game far exceeds its skill element. Also, even though the RTP of a hybrid game such as video poker and blackjack varies depending on a player's skill, the fluctuation and variance between the RTP of an advanced player and an average player is not significantly different to discourage a novice player from playing.

With the exception of video poker and blackjack, introducing hybrid games to the casino floor has proven to be a very difficult task. When 5-card draw video poker was first introduced into casino floors, players embraced the game because it was simple and the poker concept was familiar to them. Generally, players are not willing to learn the rules of a brand new casino game and tend to shy away from any hybrid game that does not look familiar. Video poker games were an exception mainly because most people knew how to play poker and were familiar with the ranking of poker hands. For example, they knew a three of a kind hand was better than two pairs.

One of the reasons for popularity of a game such as video poker is that a player, who is not mathematically proficient, nevertheless has a fair chance of winning when playing a video poker game. By using statistical analysis and by making the assumption that a player always makes the right decisions, one can calculate the theoretical RTP of a game for the purpose of meeting the regulatory standards. On the other hand, if the outcome of a hybrid game depends on the player's reaction speed, reflexes or other physical abilities, the RTP of a game becomes more challenging to measure, which is one of the reasons of a lack of casino games that depend on a player's dexterity. It has become apparent that millennials would prefer games that require decisions and speed, rather than games that are purely based on luck.

Another challenge the gaming industry is facing relates to peer-to-peer games such as online poker, a game that has been around for decades but became very popular about twenty years ago when Texas Hold'Em games started to be televised. Online poker is now gradually losing steam because novice players, commonly referred to as 'small fish', have been realizing that, in long run, have no chance of winning against the more skilled players, commonly referred to as 'big fish'. As the big fish keep eating the small fish, operators are now finding that it is harder and harder to harvest new fish. The mismatch of having imbalanced players competing against each other does not exist in physical games such as boxing or wrestling where it is common to have athletes within the same category e.g. those who are in the same weight range, to compete with athletes of a similar weight. However in the case of mental-based games such as poker, keeping the big fish away from the small fish has not been solved.

Horse racing is another wagering activity that is in slow decline. Horse racing has had a long and distinguished history, has been practiced in almost all civilizations across the world since ancient times and its basic premise of wagering on fastest horses has remained unchanged for centuries. However, in just the last two decades, total attendance at racetracks has dropped by nearly 50%, forcing many tracks to shut down. Racing takes time to master; the more time one spends studying a race, the better chance one has to win. Overall, the learning curve for mastering horse racing wagering is simply too steep and today's average person does not have the time or the patience to acquire such skills in order to compete with more-informed players.

SUMMARY

The embodiments described herein relate to methods and apparatus for determining two or more game payouts in a game based on both skill and chance, sometimes referred to herein as providing a "dual-meter" or "dual-metering" gaming system to improve a gamer's experience and to level the playing field between players with different skill levels. In one embodiment, a gaming device, either stand-alone or networked, apportions/assigns wagers or payouts between skill and chance, with the skill wager/payout being rewarded if the player follows the game's optimal play. In a networked embodiment, a server provides most of the functionality for determining the two or more game payouts.

In another embodiment, a gaming system employs the above dual-meter wager/payout splitting concept to peer-to-peer gaming, for games such as poker, to assess the skill of the players against the game's optimal play, in order to assist less-skilled players against more-skilled players. To level the playing field for games such as poker, a percentage of a pot may be allocated to chance and may be split between those who get a qualifying hand or, alternatively, the system may compensate weaker players with rakebacks or a portion of the pot.

In another embodiment, the dual-meter concept may be applied to peer-to-peer gaming system comprising remote players participating in a live game, where the gaming system removes virtual cards from one or more virtual decks based on actual cards dealt by a live dealer during game play, such as described in U.S. Pat. Nos. 8,414,401, 8,162,760, and 9,092,935, all owned by the Applicant of the present application and incorporated by reference herein. In a variation of this embodiment, the game may have been pre-recorded with game values removed from the virtual cards of each virtual deck, and game players compete with each other by checking, folding or calling when the players at the pre-recorded game raise a stake in the game.

In yet another embodiment, dual-meter concept is applied to a pari-mutuel wagering system, where an element of chance is added to a game of skill to assist less-skilled players against more-skilled players. In pari-mutuel horse racing, for example, experienced players and those with more knowledge about the horses have a much better chance of winning than novice players. By adding a second pool to a race, the result of which depends on either a random drawing or the actual outcome of the race, less-skilled players have a higher chance to win in a hybrid pool than participating in a traditional pari-mutuel pool.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein:

FIGS. 6*a*-6*f* show various states of a Balance meter, a Wager meter, a Win-Total meter, a Win-Chance meter, and a Win-Skill meter, used to display balance information, wager information, total win amount, win amount based on chance, and win amount based on skill, respectively, to a game player;

FIG. 7 illustrates one embodiment of a payout table used to determine payouts based on chance in a game of 5-card draw poker;

FIG. 11 is an overview diagram illustrating one embodiment of a dual-meter pari-mutuel pool for horse racing;

FIGS. 13*a*-13*c* illustrate the meters shown in FIG. 1 illustrating another embodiment, where wagers are apportioned 70% to a chance component, 20% to a skill component and 10% to a skill-based progressive jackpot.

DETAILED DESCRIPTION

Figure 1:
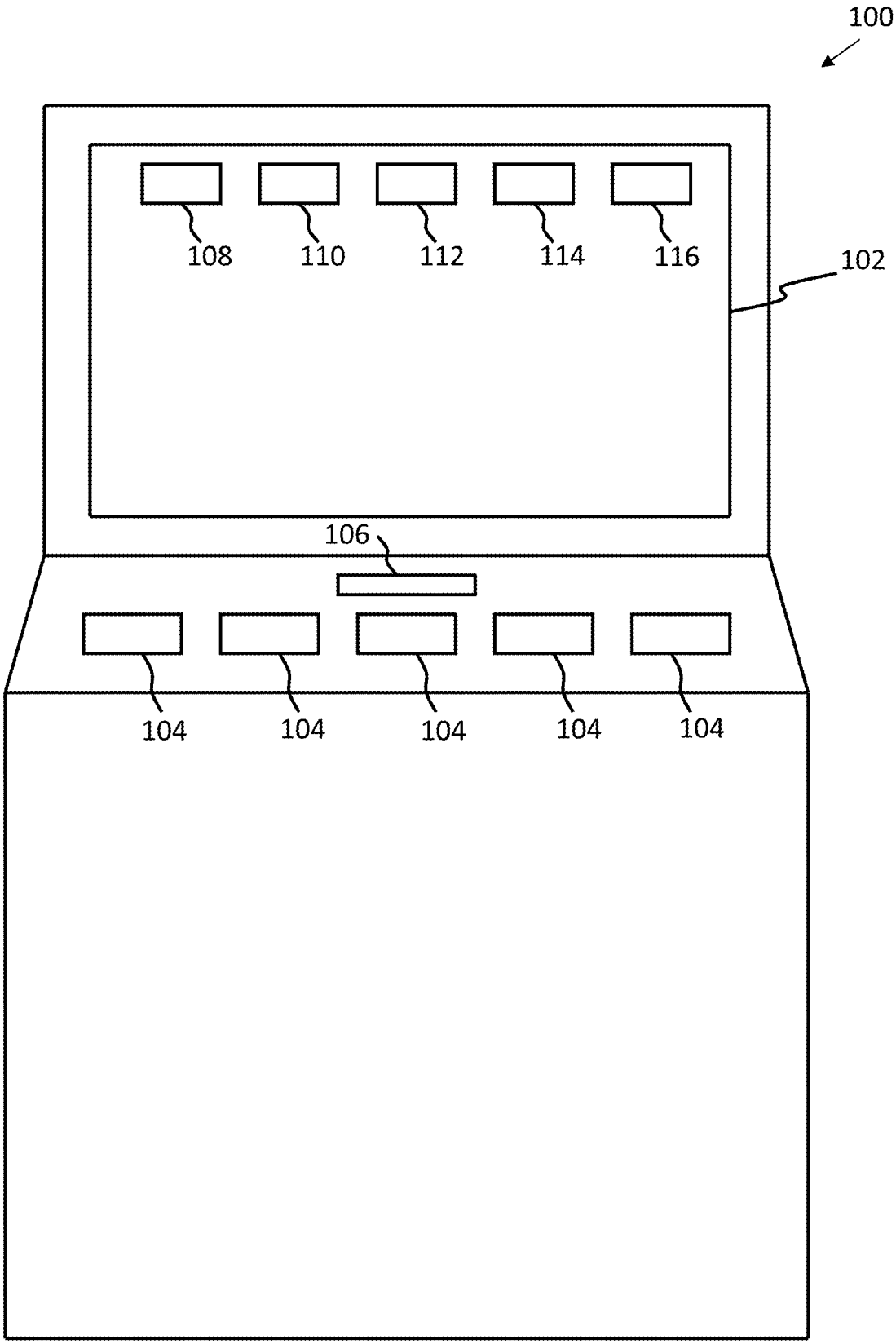
FIG. 1 is an illustration of one embodiment of a gaming device that utilizes "dual-metering" for rewarding players based on their skill at playing a game as well as on a chance component.

It should be noted that throughout this document, the terms "player", "patron" and "gamer" are used interchangeably, and also that the term "game" is used to describe casino-based games, arcade games, hand-held games, and sever-based games. The word "operator" may be used to refer to a casino owner, operator, management and/or employee(s), an arcade owner, operator, management and/or employee(s), or owner, operator, manager and/or employee(s) related to a gaming server. Finally, the terms "gaming industry" and "casino industry" are used interchangeably.

The word "game", as used herein, is broadly defined: game theory scholars and economists believe that whenever humans interact with each other, whether driving, dating, or other activities, they are negotiating or participating in an action of playing a game. Applying this general principle to the gaming industry, operators and players effectively are involved in a game, for example a casino operator's strategy is to entice players to play more often and longer, while a player's goal is to be entertained and to win. Similarly, in the case of arcade and amusement businesses, an operator's strategy is to get players entertained with the most engaging and challenging games, and enable them to test their skill levels or compete with each other. Applying the same analogy, operators are involved in marketing games to players, for example, in the case of land-based casinos, operators use various marketing gimmicks to play a game of enticing players to go to their casinos and players play a game of selecting which casinos to go to. Once inside a casino, operators play a game of providing a variety of games that are most appealing to players, and players play a game of selecting games that give them the best entertainment value and the best chance to win.

Online casino operators also play similar games with their players, playing a game of enticing players to enter into their sites and online players play a game of selecting which sites to go to and once inside, which games to play.

Another relevant term in the gaming industry is 'utility', which economists define as a measure of happiness. In some cases utility refers to monetary values. However, in most cases, utility has a much broader meaning. Applying the utility principles to the gaming industry, the utility of an operator may include the net win of a game less the cost of marketing, comps, rebates and promotional campaigns, such as those attracting players to come to their casinos. For example, a bingo game could be a loss leader to attract players to visit a casino because others who accompany the bingo player might enjoy playing slot machines. As it relates to players, their utility may include an entertainment value of playing a game, payout amounts and other monetary values such as comps and rebates received from an operator, as well as subjective values such as bragging rights and recognition by other players. Overall, whether a game is based on chance, skill or a blend of the two, players are looking to maximize their utility, which may include both monetary value and subjective value such as being recognized for their skills.

To maximize their utility, casino operators may seek to maximize their net revenues per square foot and balance their casino floor with a diversified set of games that appeal to different demographics, making sure their house advantage on every game is maintained and their portfolio of games entertain a wide demographic of players with a balanced risk and reward structure. Operators are now realizing the interests of traditional casino players and millennials are very different. To maximize their utility, operators may offer games that appeal to both baby boomers that are used to playing traditional games of chance and millennials who tend to shy away from traditional games of chance. To make an adjustment, operators need to track and assess skill levels of their players, change their current game offerings and measure their initiatives by evaluating the performance of their new games against their existing, traditional games.

Embodiments of the present invention seek to address these issues by introducing a "dual-meter" feature to gaming machines and gaming servers, which blend skill-based games with games of chance, for maximizing an operator's utility as well as the utility of players having different interests and skill levels, ranging from those who have high skills to those who have no skills in playing a particular game. The dual-meter feature may be employed on a wide variety of dedicated gaming machines, network-based gaming servers, or on mobile computing devices, such as smart phones and tablet computers. It may also be employed in systems that track and manage live-action wagering, such as systems that track and manage wagering on dog or horse racing, card games, keno, bingo, etc. Each of such devices that offer the dual-meter feature may be referred to herein as a "gaming platform".

In the embodiments described herein, a first "meter" is used to determine payouts based on a skill level of a player, while a second meter is used to determine payouts based on chance. In one embodiment, a gaming platform splits a player's wager, before the start of a game, into two separate portions, one allocated to chance and one allocated towards skill, as the gaming platform assesses the player's skill during the game. The wager portion allocated to chance may be displayed to the player via a "chance meter" or "chance display" on the gaming platform. The wager portion allocated to skill may be displayed to the player via a "skill meter" or "skill display" on the gaming platform. A processor coupled to the chance and skill displays determines a player's skill level by, in one embodiment, comparing a determined skill level against an optimum strategy of playing a particular game. The processor may be programmed to achieve an optimum level of utility for players with different levels of skill by splitting wagers differently between a chance element and a skill element, depending on the particular game being played.

In another embodiment, a meter can display casino loyalty point rewards on a play-by-play basis. Currently casino loyalty points are awarded outside of a game, and oftentimes players do not know how and when the rewards were made. For example most rewards programs awards players based on duration of play and denomination of play at slot machines or table games. Awarding points or issuing promotional vouchers during a game that is tracked by a separate meter could add utility to a player and provide an additional tool to an operator to let its patrons maximize their utilities. The award level of in-game loyalty points may vary depending on several factors ranging from the distribution channel e.g. played on a casino's slot machine or online, time and day of play, skill level of a player etc. Overall, an operator's goal is to let players maximizes their utilities based on a game's offerings such as its graphics and animation, entertainment experience, skill level, frequency of random payouts, potential to hit large jackpots as well as recognition and status earned by a player. An operator may allow players to use their rewards as a currency to gamble on a game that has a separate meter to track the points gambled and awarded. Operators may also allow players to gamble with the awards earned at other casinos or non-gaming organizations such as airline frequent flier points or loyalty points awarded by financial institutions such as purchases made on a credit card.

For peer-to-peer games such as poker, a valuation system may be used to track and assess the skill level of players to allow the system to create a level playing field among players, for example by providing disclosure and transparency to players about each player's skill level. To achieve this, the system may track, assess and record the skill level of the players, update a database associated with the system, and display players' skill levels via a display or "game meter". Depending on the type of a game, the system may incentivize or dis-incentivize players depending on their skill levels. As an example, an operator may give a higher percentage of a poker rake, commonly called a rakeback, to less skilled players. Currently, poker sites follow an opposite practice, i.e. they provide rakebacks to more frequent players, a practice that has endangered the "small fish". Another example of creating a level playing field may include paying out some of a pot or some of a rake of a peer-to peer game based on chance regardless of the game's final outcome. For example, a player in a Texas Hold'Em game may receive a payout for having a certain hand such as two pairs regardless of whether the player wins the pot.

In introducing a new game and in maximizing its utility, a gaming operator may also take into account the utility of its players as well as the industry's past experience in offering new games. Regardless of players' level of skill, players generally look to maximize their utility, which typically includes both monetary and subjective values. Historically, operators have been opposed to attracting skilled players to their casinos and have not tried to actively market to them. However, they have recently started offering slot machines with skill-based bonus features that allow a player to participate in a performance-based game during a bonus round that would affect the payouts by a few percentages to players who have different skill levels. Most of the slot games currently catering to skilled players have a triggering event for a skill-based bonus game. Other than the skill-based bonus feature, these games are fundamentally the same as traditional slot machines. Overall, operators have avoided replacing a proven game with a new game that has no track record, but they have been willing to try games that are derivatives of traditional games. Historically, it has been proven that a game that is close to a traditional game has a higher chance of getting player acceptance than a new game that requires a lengthy explanation on how to play the game, or is not an easy game to learn.

In summary, embodiments of the present invention introduce the concept of payouts based on both skill and chance to address some of the challenges the casino industry is facing in catering to millennials. It should also be noted that the skill/chance payout concept could be applied to almost any type of game, although the embodiments described here cover only a small number of game examples that are variations of existing, popular games. For example, the skill/chance concept can be applied to existing casino video games such as a 5-card draw poker and an arcade and amusement type game such as Call of Duty (a game that is based on a first shooter concept in a fictional battle). In the case of a 5-card draw poker, a player's skill is determined as the player plays the game in order to track and reward the player's performance against an optimum strategy of playing the game, in addition to rewarding the player based on luck. In the case of an arcade/amusement type game such as Call of Duty, a player's skill level is determined, for example, by converting occurrences of various, potential events into a probability pattern so that their likelihood can statistically be calculated.

Generally, a game of chance has a combination of random outcomes with expected payoffs that add up to an amount less than the amount wagered. Since skill-based video games usually have a series of tasks, it is possible to convert the theme of a skill-based game to a game of chance by randomizing one or more of its tasks. The conversion process, however, should include a paytable with a structure that has higher payouts for more challenging tasks with the game's total expected payouts to be less than the wager amount. Thus, a skill-based video game could be converted into a game based on both skill and chance by rewarding players a portion of their wager amount based on their skill at playing the game as well as the player's performance based on chance. The player's skill may be based on a comparison of the player's actual play vs. the best strategy for playing the game, giving those who have the least amount of deviation from the best strategy the highest reward for the skill-based component. When players play according to the best strategy, they may get credited one or more points and when they don't, they may lose one or more points or earn no points and in a tournament-style game, a player's skill or score may be assessed against proven skilled players, e.g. poker pros who won a major championship.

The casino industry's pursuit of converting arcade-style games to games purely based on chance must appeal to a wide demographic of players. Otherwise they would not be commercially viable products. The risk of converting an arcade-style game into a chance-based game is that it might not appeal to millennials, who are comfortable with video games, or to baby boomers and generation X, who are generally slot players. A hybrid game that has both chance and skill elements has a better probability of succeeding if its theme is based on a brand or is an already popular game. Further, if a game involves too much skill, it might not appeal to traditional slot players and, vice-versa, if a game involves too much chance, it may not appeal to millennials. To appeal to all demographics, including millennials and baby boomers, converting a traditional skill-only or chance-only game to ones that involve both skill and chance must follow a fine line. Embodiments of the present invention address these challenges, allowing a casino-style game of chance to divide a player's wager into two components, one component based on a chance element and the other based on a skill element. Embodiments of the invention also introduce a skill-tracking and determination system to determine and rank a player's skill level. The skill-tracking and determination system creates a process and a structure to act as a catalyst in creating a level playing field between players with different skill levels, and may compensate weaker players against stronger players. This feature relies on the general principle that the long-time survival of a game depends on creating a level playing field by taking into consideration both monetary and subjective values in order to maintain players' interest in the game.

FIG. 1 is an illustration of one embodiment of a gaming device 100 that utilizes "dual-metering" for rewarding players based on their skill at playing a game, as well as on a chance component. The term "dual-metering", as used herein, refers to separately tracking and displaying two game outcomes for each game played. A first game outcome is determined by chance, i.e., by a random number generator, and a second game outcome is determined by skill, i.e., in one embodiment, how close a player comes to playing a game in accordance with an optimal strategy. Although gaming device 100 is shown in FIG. 1 as a stand-alone, electronic gaming machine (EGM), such as a casino slot machine or video poker machine, gaming device 100 could alternatively comprise a networked casino EGM, a mobile device such as a smartphone, a virtual reality headset or a tablet computer, or a personal computer. In the case of a networked gaming machine, gaming device 100 could merely comprise an electronic user interface to a gaming server, wherein the gaming server performs operations to provide one or more games to players, manage wagers and payouts, and essentially control all aspects of game play. While the remaining discussion with respect to FIG. 1 is in terms of a stand-along, casino EGM, it should be understood that the concepts described as applied to gaming device 100 could be equally applicable to a networked casino EGM, a mobile device such as a smartphone or tablet computer, or a personal computer.

In one embodiment, gaming device 100 comprises a user interface, comprising display 102 and user input 104, and value exchange mechanism 106. Electronic games, such as video poker, traditional and newer slots, keno, bingo, etc., are presented to players via display 102, and user input 104 is used to receive player input as the game is being played, such as user selection of various options as the game progresses. Value exchange mechanism 106 is used to accept some form of value from players prior to game play, such as money, credit or debit cards, vouchers, etc. to establish a "bank" that the player uses to place wagers from. As such, value exchange mechanism 106 may comprise a bill reader, a credit/debit card reader, a scanner, and/or any other technology that may be used to receive value from players. In general, once a player enters some form of monetary value into gaming machine 100 via value exchange mechanism 106, the player may begin playing a game, sometimes choosing from a selection of games offered by gaming machine 100 via display 102. In other embodiments, value exchange mechanism 106 could be shown on display 102.

User input 104 may comprise physical buttons, keys or the like, and/or may comprise "soft keys" such as one or more "mini-displays" for displaying processor-generated images representing various forms of input available to a player, such as wager amounts and player input, such as selecting electronically-displayed cards for keeping in a game of draw poker, a "spin" button for slots or electronic wheel of fortune game, "hit", "stay", "double" selections for electronic blackjack, etc. Display 102 comprises any one of a number of well-known electronic displays, such as LCD, and may in some embodiments comprise a touchscreen, allowing players to enter player input via display 102.

In the embodiment shown in FIG. 1, gaming device 100 comprises five "meters" 108, 110, 112, 114 and 116. Each meter comprises a section of display 102 dedicated to show certain information to players. While five meters are shown in FIG. 1 as dedicated sections of display 102, it should be understood that in other embodiments, a greater or fewer number of meters could be used, and that the meters could comprise small, independent electronic displays located on gaming machine 100, such as above or below user input 104. The meters are used to show, for example, a player's bank, current wager, and game outcome information in the form of total dollars won during each round of game play, as well as game outcomes based on skill and on chance, as will be described later herein.

Figure 2:
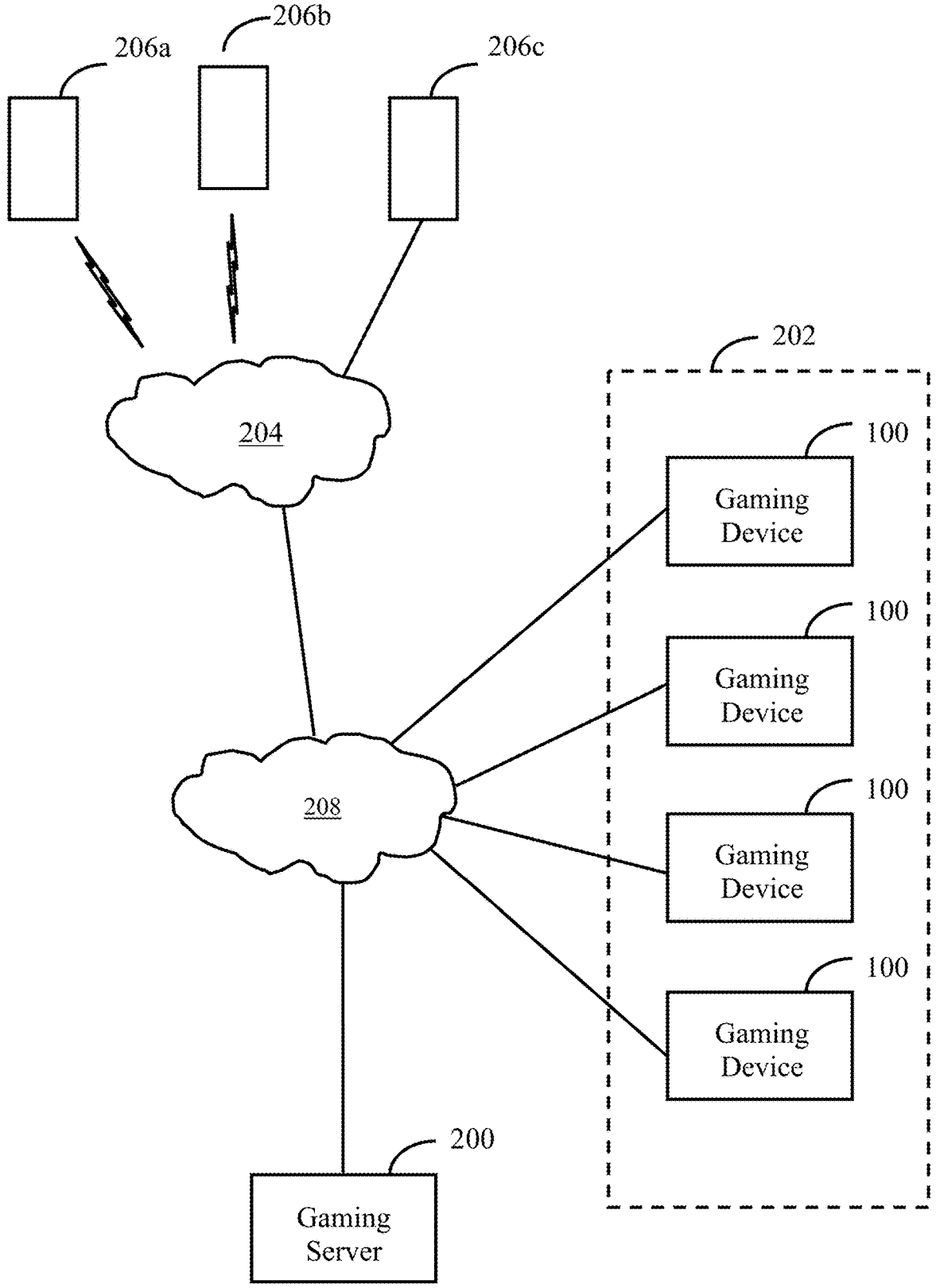
FIG. 2 illustrates one embodiment of a gaming system employing "dual-metering", comprising a gaming server networked to a bank of local gaming devices via a local-area network.

FIG. 2 illustrates one embodiment of a gaming system, comprising gaming server 200 networked to a bank 202 of gaming devices 100 via local-area network 208. In this embodiment, gaming server provides one or more games of skill and chance to each of the gaming devices 100, receives player input as each game is played, and monitors and tracks players' bank, wagers, and game outcomes. Such systems are well-known in the art. Gaming server 200 may allow two or more players to play certain games with or against each other, either at a single location where bank 202 is located, and/or over wide-area network 204 via players' personal electronic devices, such as smartphones, tablet computers, personal computers, etc. For example, three remote players operating personal electronics devices 206*a*, 206*b*, and 206*c* could play a game of blackjack with each other against a "house" entity as gaming server 200 acts as a dealer, or they could play a game of poker, such as Texas Hold'Em, against each other with gaming server 200 acting as a dealer. Although only three personal electronic devices are shown in FIG. 2, it should be understood that server 200 is capable of managing numerous simultaneous and varied games among hundreds or even thousands of remote players, each using their own, respective personal electronics devices.

Figure 3:
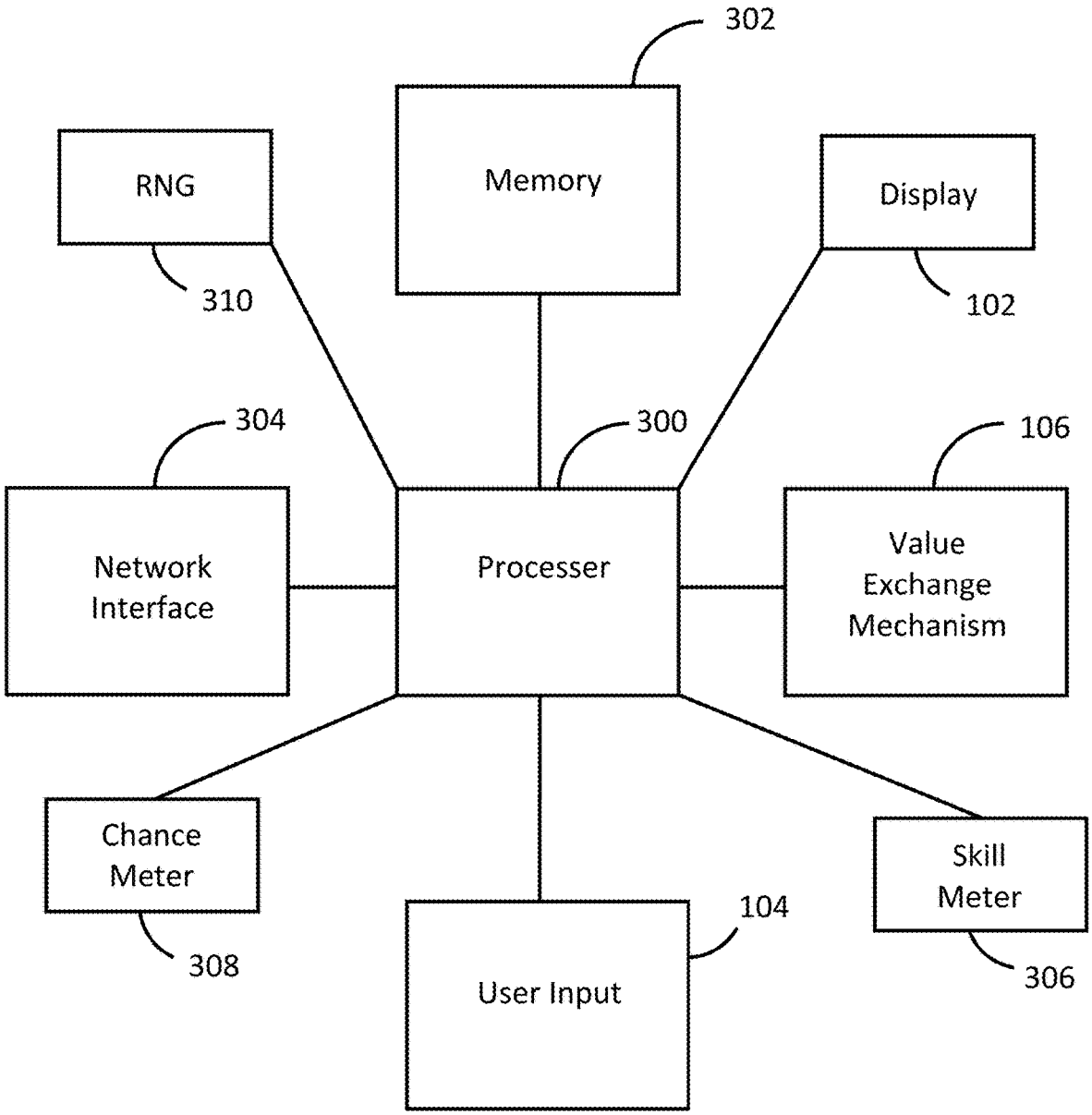
FIG. 3 is a functional block diagram of one embodiment of the gaming device as shown in FIG. 1.

FIG. 3 is a functional block diagram of one embodiment of gaming device 100, comprising processor 300, memory 302, display 102, user input 104, value exchange mechanism 106, network interface 304, skill meter 306, chance meter 308 and random number generator (RNG) 310. Although FIG. 3 shows gaming device 100 as having network communication capabilities via network interface 304, two physical meters 306 and 308, and RNG 310, in other embodiments, gaming device 100 does not have such network communication capability and/or the use of physical meters, instead using display 102 to convey information pertaining to game outcomes based on chance and on skill. In addition, gaming device 100 could have a greater, or fewer, number of meters. Finally, RNG 310 may not be included in embodiments where game outcome determinations are performed by server 200 in an embodiment where gaming device 100 is a network-based game machine.

Processor 300 is configured to provide general operation of gaming device 100 by executing processor-executable instructions stored in memory 302, for example, executable code. Processor 300 typically comprises a general-purpose processor, such as an i5 processor manufactured by Intel Corporation of Santa Clara, Calif., although any one of a variety of microprocessors, microcomputers, and/or microcontrollers may be used alternatively.

Memory 302 comprises one or more information storage devices, such as RAM, ROM, EEPROM, UVPROM, flash memory, SD memory, XD memory, or other type of electronic, optical, or mechanical memory device. Memory 302 is used to store processor-executable instructions for operation of gaming device 100, as well as any information used by processor 300 to conduct games, such as player bank information, present wager amount, skill payouts, chance payouts, "cards" played, "bingo balls" selected, keno numbers "drawn", payout tables, etc.

Network interface 304 comprises circuitry necessary for processor 300 to communicate over one or more networks, such as wide-area network 204 and/or local-area network 208. Such circuitry is well known in the art.

Skill meter 306 comprises a physical or virtual meter for displaying a payout amount associated with a player's skill at playing a game, sometimes referred to herein as the "skill element". In one embodiment, when a wager is placed prior to game play, processor 300 splits the wager into a chance component and a skill component and, during game play, determines whether a player played the game in accordance with the game's optimum strategy and in some embodiments, a degree to which the player played in accordance with the optimal strategy. For example, in blackjack, an optimal strategy is to "stand" on any initial hand if the dealer shows a "5" or a "6" and "draw" if the dealer shows high cards such as a "9" or a "10". Whether or not the player wins the game in the traditional sense, i.e., the player wins as determined by RNG 310, processor 300 determines a skill payout based on the player's skill as determined by processor 300, and the skill payout is displayed by skill meter 306. This concept is referred to herein as the "skill outcome" and is described in greater detail below.

Chance meter 308 comprises a physical or virtual meter for displaying a payout amount associated with a player's luck or "chance" in playing a game. The chance component of a wager is typically based on the odds of various game outcomes occurring, modified to benefit "the house" over the long term. For example, in a traditional video poker game, a straight may pay 4-1. Obtaining a straight, whether a player played the game in accordance with best practices or not, represents a chance outcome of the game, determined by RNG 310 randomly assigning electronic card values to the player. In one embodiment, a chance outcome is determined by RNG 310, either with or without player input (i.e., whether a player selects one or more cards to be "held" in a video poker game, whether a player "hits" or "stands" in a blackjack game, etc.) As mentioned in the above paragraphs, wagers may be split into a chance component and a skill component. When a player "wins" a game based on the chance element, regardless of whether the player played the correct or optimal strategy during the game, processor 300 determines a chance payout based on a payout table stored in memory 302 (as shown in FIG. 7) and the chance component. This concept is also described in greater detail below.

Figure 4:
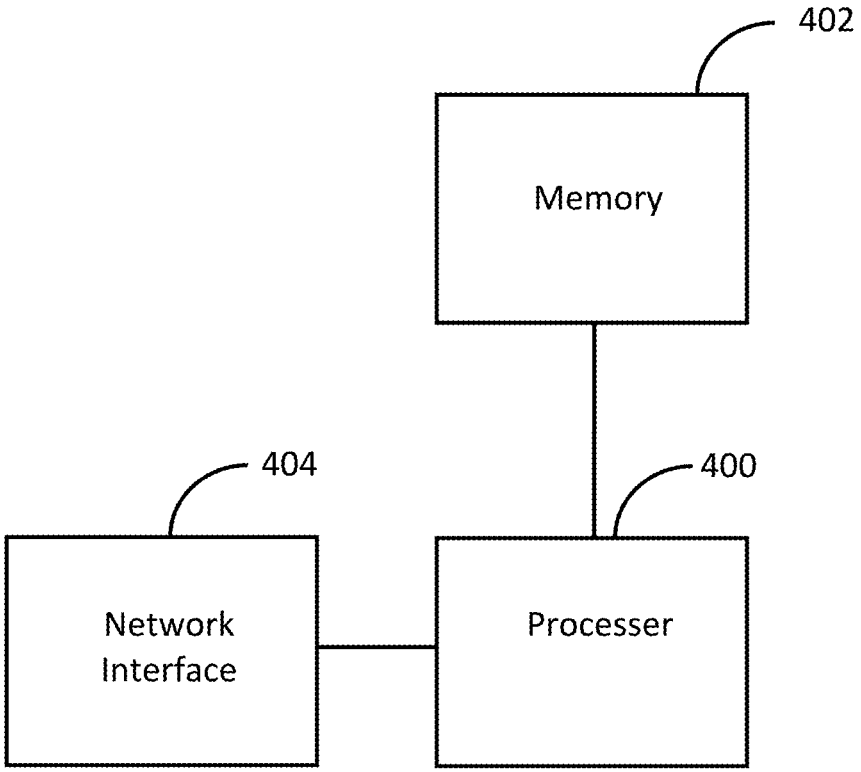
FIG. 4 is a functional block diagram of one embodiment of the gaming server as shown in FIG. 2.

FIG. 4 is a functional block diagram of one embodiment of server 200, comprising processor 400, memory 402, and network interface 404. Server 200 is used in conjunction with one or more networked gaming devices 100 and/or personal electronic devices 206.

Processor 400 is configured to provide general operation of server 200 by executing processor-executable instructions stored in memory 402, for example, executable code. Processor 400 typically comprises a general-purpose processor, such as an i5 processor manufactured by Intel Corporation of Santa Clara, Calif., although any one of a variety of microprocessors, microcomputers, and/or microcontrollers may be used alternatively.

Memory 402 comprises one or more information storage devices, such as RAM, ROM, EEPROM, UVPROM, flash memory, SD memory, XD memory, or other type of electronic, optical, or mechanical memory device. Memory 402 is used to store processor-executable instructions for operation of server 200, as well as any information used by processor 400 to conduct games, such as player bank information, present wager amount, skill payouts, chance payouts, "cards" played, "bingo balls" selected, keno numbers "drawn", payout tables, player account information, etc.

Network interface 404 comprises circuitry necessary for processor 400 to communicate over one or more networks, such as wide-area network 204. Such circuitry is well known in the art.

In operation, processor 400 offers one or more electronic games to players, the games stored in memory 402, by causing gaming devices 100 and/or personal electronic devices 206 to display game availability information on a respective display. Players interact with server 200 via gaming device 100 or personal electronic devices 206 via wide-area network 204 in order to select and play games. Player input, such as player account credentials, game selection, account funding (via value exchange mechanism 206 or via wide-area network 204, and in-game choices ("hit", "stand", "spin", "draw", "hold", etc.), is provided from user input 104 or personal electronic devices 206 over wide-area network 204 to network interface 304 and to processor 400 in real, or near-real time, and processor 400 responds to sending data back to gaming devices 100 and/or personal electronic devices 206 with information such as win determination, payout amounts (both for skill and chance components), results from RNG 310 (i.e., one or more a new cards, a keno number, a bingo number, a roulette wheel result, etc.), and in some cases, information from one or more players sent to other players. For example, in a game of Texes Hold'Em, bets, calls, raises, etc. are sent from one participating player to the other participating players. For each game, processor 400 calculates a skill payout and a chance payout, as will be explained later herein.

Figure 5:
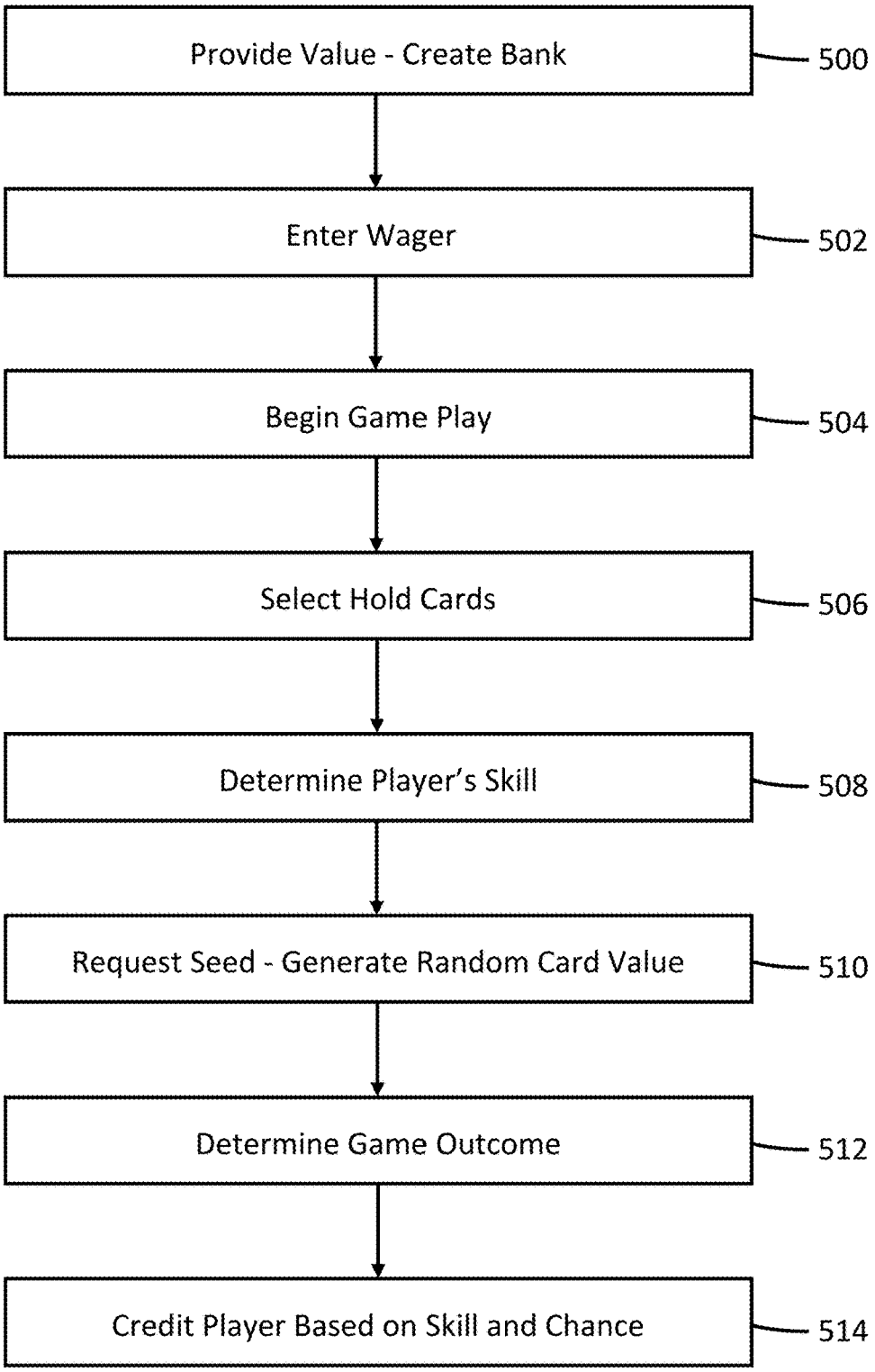
FIG. 5 is a flow diagram of one embodiment of a method, performed by either the gaming device shown in FIG. 1 or the server shown in FIG. 2, for determining game outcomes of a game based on both skill and chance.

FIG. 5 is a flow diagram of one embodiment of a method, performed by either gaming device 100 or server 200, for determining game outcomes of a game based on both skill and chance. In this regard, when referring to processor 300, it should be understood that the described functionality could likewise be performed by processor 400. In this embodiment, gaming device 100 comprises a stand-alone EGM offering a game of jacks or better 5-card draw poker, with a payout table stored in memory 302 as illustrated in FIG. 7, modified to pay players in accordance with both their skill at playing the game as well as a chance component. While the method is described in terms of gaming device comprising a stand-alone EGM offering jacks or better 5-card draw poker, it should be understood that the concepts described herein could be applied to a wide variety of other games of chance and skill.

It should be understood that the steps described in this method could be performed in an order other than what is shown and discussed. Further, it should be understood that gaming sever 200 could be running tens, hundreds, or even thousands of different games simultaneously. In this embodiment, gaming device 100 comprises five "meters" 108, 110, 112, 114 and 116, represented by the meters shown in FIG. 6 as "Balance", "Wager", "Win-Total", "Win-Chance", and "Win-Skill", respectively. Each meter comprises a section of display 102 dedicated to showing certain information to players, or individual, small displays. The meters are coupled to processor 300, where information displayed by the meters is provided. It should be understood, however, that in other embodiments, a greater or fewer number of meters could be used to convey a player's financial standing as the players play one or more games provided by gaming device 100.

At block 500, a player deposits funds into a "bank" managed by gaming device 100 or server 200, for example, by tendering bills, vouchers or credit/debit cards to value exchange mechanism 106 or electronically via user input 104 in conjunction with server 200, as is well-known in the art. In this embodiment, the player deposits $100, and processor 300, in response, causes balance meter 108 to display "$100", as shown in FIG. 6*a*, to highlight the player's available funds for wagering. The deposit could be for real money or for points and may be made either by the player, by an operator of gaming device 100 or by a third party.

At block 502, the player uses user interface 104 to enter a wager amount, in this example, $10. The wager amount is provided to processor 300 and, in response, processor 300 reduces the player's available balance to $90 and credits the player's wager amount to $10. Processor 300 also causes balance meter 108 to display $90 and wager meter to display $10.

Figures 8A, 8B, 8C:
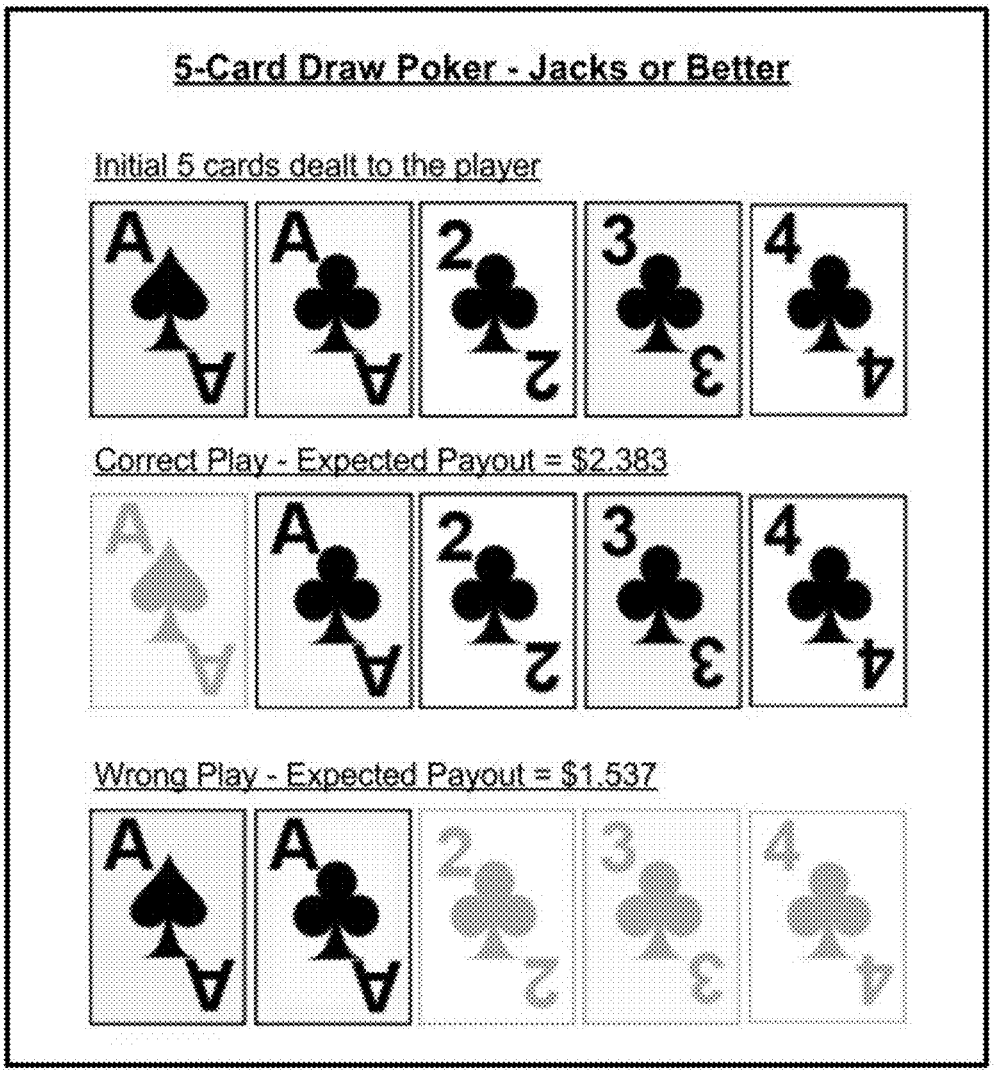
FIGS. 8*a*-8*c* illustrate 5 cards in a 5-card poker game, with FIG. 8*a* illustrating a typical starting hand, FIG. 8*b* illustrating correct play in response to the first starting hand and FIG. 8*c* illustrating incorrect play in response to the first starting hand.

At block 504, after the wager has been placed by the player, processor 300 begins the game by causing display 102 to display 5 initial cards, in this example two unsuited Aces, a 2, a 3 and a 4 of the same suit as the one of the Aces, as shown in FIG. 8*a*. In one embodiment, the cards are a result of RNG 310 providing random "seed" values to processor 300, and processor 300 converting the random seed values into electronic cards having a numeric value and a suit. In other embodiments, a random card value may be generated solely by processor 300 or by RNG 310.

At block 506, the player selects which cards the player would like to hold via user input 104, thereby indicating which cards the player would like to replace with new cards. The player's selection is provided to processor 300.

At block 508, the player's skill is determined by processor 300. This may occur one or more times during a round of game play, and/or it may occur at regular time or play intervals during a single round of game play or over the course of many games. The correct strategy of playing this hand is to discard the Ace that is not of the same suit as the other four cards, with an expected payout of $2.383 for a $1 wager with a standard payout table for a "Jacks or Better" game, as illustrated in FIG. 8*b*. If the player discards any other cards such as the one illustrated in FIG. 8*c*, i.e. holding the two Aces and discarding the other 3 cards, the player's strategy would be a wrong one resulting in a lower expected payout of $1.537. In this example, the player plays the correct strategy, discarding the Ace that is not of the same suit as the other four cards. For any game, an optimal strategy may be defined and stored in memory 302. For example, Texas Hold'Em has its own definitions of what optimal strategy might be based on a variety of possible starting hands (i.e., raise with an initial, suited hand of Ace/King). Blackjack has its own optimal strategy based on a player's initial hand vs. a face card shown by a dealer (i.e., double down on 11). The optimal strategy may, in one embodiment, be based on an expected payout table stored in memory 302. In draw poker, for example, an expected payout table provides payout amounts based on the odds of the player receiving certain cards during the "draw" and/or combined with the overall probability of the player receiving certain hands times each hand's payout. For example, if a player holds the Ace, two, three and four of club as shown in FIG. 8*b*, the odds of drawing a five of club to complete a straight flush is one in 47 and the payout for receiving a straight flush, from the payout table stored in memory 302, is 50:1. Using probability theory the expected payout is $2.383 for a $1 bet. If the player decides to hold the two Aces, total expected payouts of getting low probability hands such as hitting four of a kind, full house, three of a kind, two pairs are less than the expected payout of getting a straight flush.

In one embodiment, processor 300 assigns a zero or a negative result to the skill level if a player does not match at least one or more exemplary game plays stored in memory 302, and further assigns a positive result to the skill level if a player does match at least one or more of the exemplary game plays. A negative result may be defined as decreasing a numerical score assignment to the player while a positive result may be defined as increasing the numerical score. For example, a player's skill level could be ranked between 1 and 10, with 10 equating to "highly skilled" while 1 equating to "not skilled", and a continuum of skill levels ranging in between.

At block 510, processor 300 requests a single seed value from RNG 310, and RNG 310 provides one seed value to processor 300. Processor 300, in turn, generates a card value in response thereto, causing the card value to be displayed in place of the Ace that was discarded, on display 102. In this example, a six of club is generated by processor 300.

At block 512, processor 300 determines the game outcome, i.e., determines that the player ended the game with a flush, paying six-to-one.

At block 514, a credit is applied to the player's balance when a win is determined. Normally, the credit would be in an amount dictated solely by the payout table. In this case, a flush pays 6:1, meaning that normally, the player would be credited $60 for receiving the flush. In this embodiment, the player's wager or payout is apportioned into a chance component and a skill component, in accordance with a pre-defined skill/chance ratio stored in memory 302, defined by the operator of gaming device 100 and/or server 200. In this example, the skill/chance ratio is 1:10, meaning that one tenth of the wager or payout is apportioned to skill and the other nine tenths of the wager or payout is apportioned to luck or the chance of the player receiving, in this case, the flush. As a result of the player choosing the optimal strategy of discarding the single Ace, processor 300 rewards the player with a skill payout of one tenth of the original wager amount. As a result of drawing a club to form a flush (i.e., as a result of processor 300 and/or RNG 310 randomly generating a club), processor 300 also awards the player with a chance payout of nine tenths of the "normal" payout amount. As shown in FIG. 6*d*, processor 300 causes the Win-Total meter to display the total winning amount ($145), the Win-Chance meter to display $54 (0.9×6×$10 original bet) and the Win-Skill meter to display $1 (0.1×$10 original bet).

It should be understood that processor 300 apportions either the player's wager or payouts, resulting in the same payouts (i.e., the skill payout and the chance payout) to the player.

Had processor 300 and/or RNG 310 generated a different card value than the six of club at block 510, for example a seven of diamonds, the final hand would be an Ace high, not even enough to receive any payout in accordance with the payout table stored in memory 302. In this case, processor 300 would apportion the $10 original bet as before, awarding the player $0 for the chance component, however awarding the player a skill award because processor 300 determined that the player played the initial hand in accordance with the optimal strategy, as stored in memory 302, even though the chance component of the game did not result in the player achieving jacks or better. Processor 300 causes the Win-Total meter to display $1 (0.1×$10 original bet), the Win-Chance meter to display 0 (or blank), the Win-Skill meter to display $1, and the Balance meter to display $91 as shown in FIG. 6*e*.

Had the player not played the optimal strategy at block 506, for example, discarding the two, three and four of club and holding the two Aces, and had processor 300/RNG 310 generated the other two Aces in the "deck", the end result would be four Aces, paying 25:1, in accordance with the payout table. Processor 300 would then calculate a chance payout of $225 ($10 initial bet×25×0.9), however, no amount would be provided to the player as the skill payout, because the player deviated from optimal play, as determined by processor 300 comparing the player's decision to hold the two Aces with optimal strategy stored in memory 302, indicating that the best strategy would be to hold the two, three, four and five of club. Processor 300 causes the meters to display the amounts shown in FIG. 6*f*.

In another variation, had the player not played the optimal strategy at block 506, and had processor 300/RNG 310 not generated one or more card values that would have resulted in a payout to the player in accordance with the pay table stored in memory 302, then processor 300 does not award either a chance payout or a skill payout to the player, and causes the meters to display the amounts shown in FIG. 6*c*.

Figure 12A:
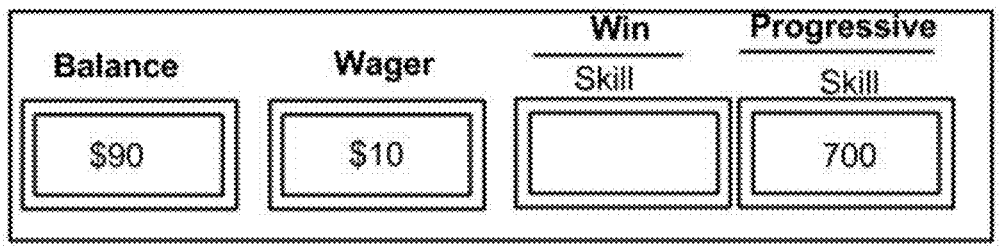
FIGS. 12*a*-12*c* illustrate four meters for use in a game based purely on skill and having progressive jackpot.
Figure 12B:
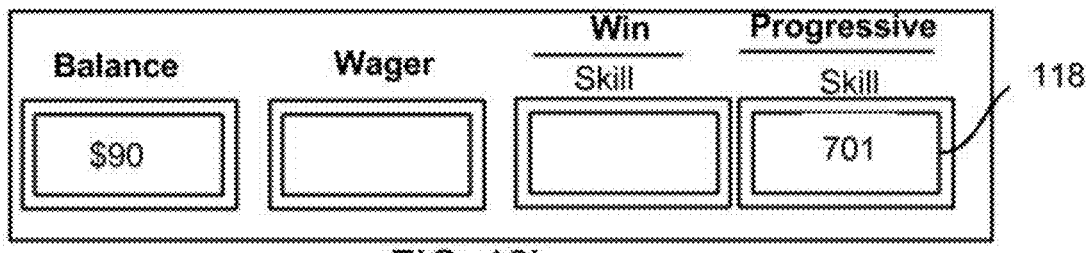
Figure 12C:
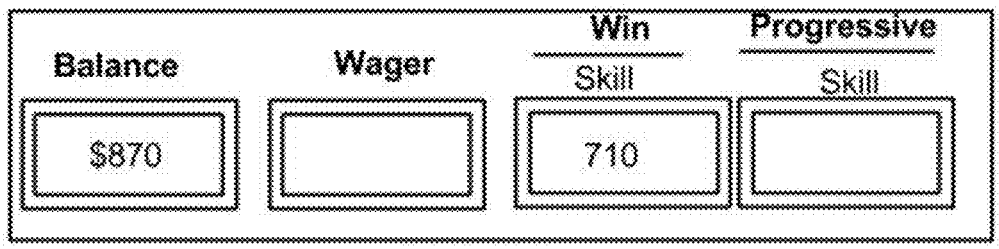

In one embodiment, when players do not adhere to the optimal play strategy, the skill payouts are accumulated by processor 300 and displayed on display 102 as a separate meter, such as a progressive jackpot meter 118, as shown in FIGS. 12*a-c*, which gets paid when a player plays a predefined number of perfect strategy hands or it could be added to one or more chance payouts of a game such as when a player hits an exceptional hand, such as a royal flush or a four of a kind, that have more probability of getting hit by a more advanced player than a casual player.

In one embodiment employing progressive jackpot meter 118, a game may be defined as purely skill-based, has no element of chance and if a player loses, processor 300 assigns a percentage of the wager, for example, 10%, to a skill-based progressive jackpot, as shown in FIGS. 12*a*-12*c*. If the player plays performs some predetermined act, for example plays in conformance with exemplary game play as stored in memory 302 a predetermined number of times, such as five times, the player is awarded the progressive jackpot by processor 300. In another embodiment, processor 300 adds the skill-based jackpot to one or more chance payouts of a game, such as when a player hits an exceptional hand, such as a royal flush or a four of a kind, that have more probability of getting hit by a more advanced player than a casual player. In another embodiment, the skill-based jackpot is paid to the player that wins a number of consecutive, such a five times, based on skill. FIG. 12*a* illustrates the meters after a player wagers $10 when the progressive jackpot is at $700. In FIG. 12*b*, the meters are shown after the player has lost the game as processor 300 has added a predetermined percentage, in this example 10%, of the player's wager of $10 or $1 to the skill-based, progressive jackpot as displayed by meter 118. In FIG. 12*c*, the meters are shown after the player has won the game after betting $10 when the skill-based progressive jackpot is at $700, with the Balance meter 108 showing $791 (the $700 progressive jackpot plus the $1 for the Win-Skill plus the $90 balance after betting).

FIGS. 13*a*-13*c* illustrate meters 108-118, illustrating another embodiment, where processor 300 apportions 70% of the player's wager to a chance component, 20% to a skill component and 10% to a skill-based progressive jackpot. In FIG. 13*a*, the player wagers $10 when the progressive jackpot is at $60. In FIG. 13*b*, the player wins 2 to 1 on chance and gets paid $14 but loses on the skill element of the game. In FIG. 13*c*, the player loses on the chance component of the game but wins both on the skill component and the progressive component and gets paid a total of $63, of which $2 is for skill and $61 is for the progressive jackpot.

The concepts described above may also be applied to electronic peer-to-peer games, such as poker, where players play against each other to win a "pot" of wagers placed by the players during the game. In these games, players often have different skill levels. In this embodiment, a portion of the pot may be allocated as a "chance pot" to be paid purely based on chance, with the game having one meter for displaying a current "pot" amount and another for displaying the current "chance pot". The purpose of this embodiment is to compensate the less skilled players in monetary and subjective values so that they do not lose their interests from participating in the game. The chance pot may be split between those who get a qualifying hand e.g. any player that gets a hand that is 3 of a kind or a better shares the chance pot regardless of the final result of their poker hands. In one embodiment, if no player finishes with a qualifying hand, the chance pot may be placed back into the main pot or may be added to a progressive meter. In one embodiment, game rules may specify that players with more skills, e.g. those who rank at least 6 out of 10, do not qualify to participate in the chance pot, or the rules might state that the chance pot be split inversely proportionally with the participating players' skill levels.

Figure 9:
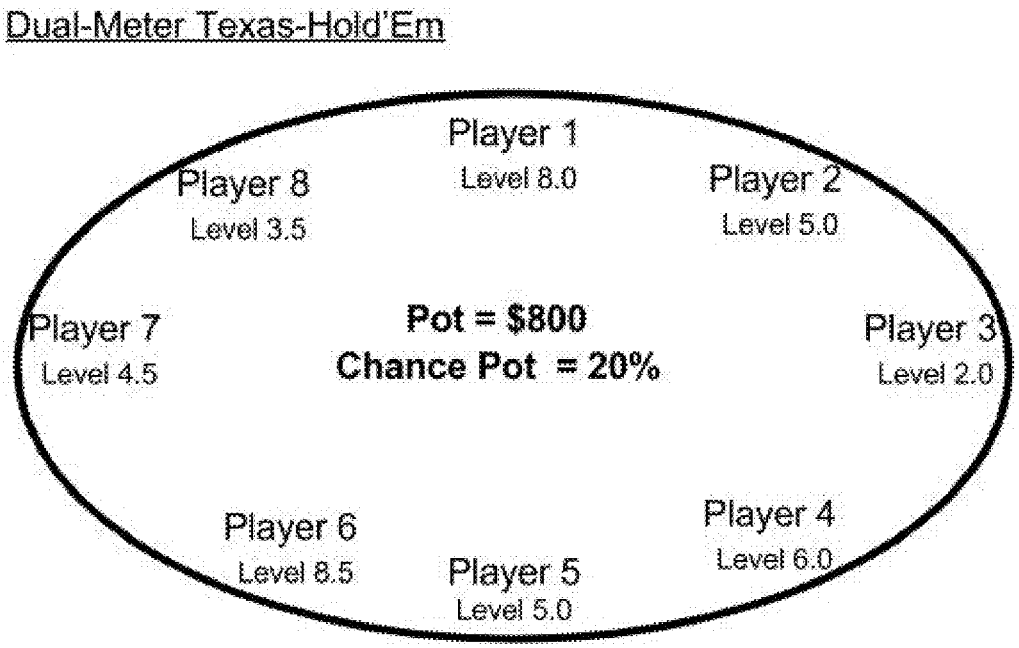
FIG. 9 is a representative diagram of eight players playing a network-based game of Texas Hold'Em, each one playing via a respective gaming device 100 in conjunction with server 200 over a wide-area network.
Figure 10:
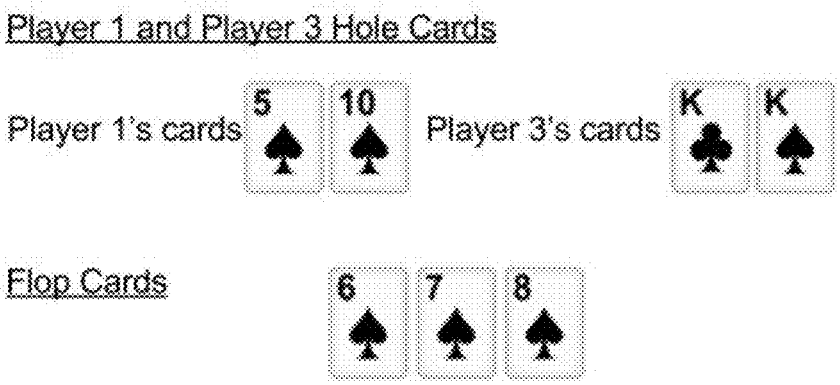
FIG. 10 is a display of two player's respective initial hands in a game of network-based Texas Hold'Em, along with three flop cards.

FIG. 9 is a representative diagram of eight players playing a game of Texas Hold'Em, each one playing via a respective gaming device 100 in conjunction with server 200 over a wide-area network, such as the Internet. In this embodiment, processor 400 allocates 20% of the main pot into the chance pot as the game progresses. In this example, players 1 and 3 receive a qualifying hand and their win amount is determined by processor 400 subtracting each player's skill level from a maximum skill of, in this example, 10. For example, player 1, whose skill level is 8 out of 10, is assigned a factor of 2 by processor 400 and player 3, whose skill level is 2 out of 10, is assigned a factor of 8. If the main pot grows to $800 at the conclusion of game play, processor 400 calculates the chance pot to be $160 (20% of $800). In this case, processor 400 awards player 1 $32 (20% of $160) and player 3 is awarded $128 (80% of $160). For new players, processor 400 may assign a mid-range score of 5 out of 10. Processor 400 then starts assessing new players' skill levels and changes their rankings thereafter based on the new players' decisions during game play. For example, if there are 9 players at a table and a player's hole cards are a 5 of spades and 10 of spades, the player has only 10% mathematical chance of winning the game before the flop, while another player who has a king of club and a king of spade has a 29% chance of winning the game before the flop. Please refer to FIG. 10. The best strategy for the player who has the 2 kings is to raise to force the players with weaker hands to fold. If the player with the kings does not raise, and the flop results in, for example, a 6 of spades, a 7 of spades and an 8 of spades, then the odds of the player holding the 5 of spades and 10 of spades winning the game increases to 63%, and the odds of the player who had the stronger hand of 2 kings winning the game is now reduced to 24%. In summary, this embodiment of awarding qualifying hands the chance pot creates more of a level playing field for players with different skill levels to maximize their utilities, which are a function of monetary and subjective values. Subjective values of less-skilled players may include the practice and the learning that occurs when playing against more-skilled players. The chance pot could also act as an effective disincentive for some skilled players from playing against the less skilled players, which could help in the long-term survival of less-skilled players. Processor 400 evaluates players' skill levels as the game is being played by comparing players' actions during the game to optimum play and strategy stored in memory 402 and, in one embodiment, based on an amount each player has at risk when each player takes an action during the game (such as bet, call, or raise) versus an expected win amount based on odds, i.e. strength of the player's hand, the revealed common cards and the amount in the main pot.

In another embodiment, the concepts discussed above could be applied to an online, hybrid poker tournament, such as a hybrid game of Texas Hold'Em, as disclosed by U.S. Pat. Nos. 8,414,401, 8,162,760, and 9,092,935, owned by the inventor of the present application, whereby a tournament may be played by players at a physical card table against players participating online. The just-referenced patents describe how cards dealt by a live dealer at the physical card table are used by server 400 to exclude such cards from being electronically provided to online players, in order to avoid duplicating cards dealt at the table vs. electronic card values generated by server 400.

In one embodiment, a Texas Hold'Em game may be broadcasted via one or more wide-area networks, such as the Internet or television networks, for viewing on electronic devices such as TVs, as an interactive television show allowing viewers to watch poker professionals playing against each other at a physical and online players participating in the same game via virtual card tables provided by server 400 over wide-area network 204. Viewers may participate in the game using a second device such as computers, tablets or smart phones to establish a bank and place wagers, as discussed above. In Texas Hold'Em, server 400 dynamically removes the professional poker players' cards from being provided electronically to online players when server 400 randomly generates card values for the online players. Server 400 tracks the chip balance of a leading player in the game and each viewer's chip balance, and displays these two balances using two, separate meters on each participant's second device.

Another variation of this embodiment may include formation of hybrid game values for viewers of an interactive show based on a pre-recorded poker game played at a physical card table, in some embodiments, played by poker professionals. As before, server 400 removes electronic versions of cards dealt by a live dealer at the physical card table, so that server 400 does not duplicate these cards when server 400 generates random, electronic card values for online players. For example, server 400 may receive indications of the game's five common cards, three burn cards and the two hole cards dealt to each poker player at the pre-recorded game. Later, viewers can compete online against the hands provided to the pre-recorded players using gaming devices 100 in communication with server 400, with server 400 providing two or more indications to meters displayed on each player's gaming device 100: one showing a chip balance of the leading pre-recorded player and another showing each respective players' chip balance. All the viewers participating in the tournament may be positioned at the 'button' or 'at the last to act position" of the table and follow the same set of rules as in poker, such as calling the big blind, checking when all the pre-recorded players check and folding or calling when the pre-recorded players raise their stakes.

In an embodiment that applies to pari-mutuel racing, use of multiple meters to track payouts may address a challenge facing the industry, such as horse racing, which over the years has been on a steady decline. This embodiment of the invention adds an element of chance to a traditional wagering event such as horse or dog racing, by introducing multiple meters. Racing is a knowledge-based game, which competes with other forms of gaming, leisure and entertainment. Racing takes time to master, the more time spent studying a race, the better chance one has to win. For a player who doesn't study racing, the probability of winning a low-percentage wager, i.e., a trifecta in horse racing (picking three horses that finish first, second, and third, in exact order) when 9 horses are running is 1 out of 504. However, for an experienced handicapper that eliminates 4 horses as not finishing in the top three, the probability of winning a trifecta is 1 out of 60 which is 8.4 times better than the odds for a novice player.

One way to revive the racing industry is to introduce dual-pool payouts. A first pool may be defined as a traditional pool i.e. the same as the current pari-mutel pools offered by tracks nationwide, and a second, new pool defined as "hybrid pool" that would also be a pari-mutel, pool but pays based on some element of chance. A hybrid pool creates a mixture of real winners and random winners. Having the hybrid pool may entice average players to racing, creating a new customer base. Taking a trifecta as an example, players placing wagers in a horse race having dual pools may choose to bet on a trifecta, where they could win based on the result of a random drawing and the result of the actual race. The random drawing may occur immediately after the race and after removing the winning horses. As an example, if horse 6 comes in first, horse 3 comes in second and horse 5 comes in third, then these numbers i.e. 6, 3 and 5 may be removed from the virtual population of 1 to 9 horses before the random drawing takes place, to establish which random horse will be first, second and third. If, in the random drawing, horse 2 was randomly selected first, horse 4, then horse 7, then anyone who had selected any combination of horses 6 or 2 to win, horses 3 or 4 to place, and horses 5 or 7 to show would win the Hybrid trifecta. In this example, the hybrid pool would generate 8 combinations of winners and provide winning opportunities for a whole spectrum of both skilled and non-skilled players, which a traditional pool does not offer.

FIG. 11 is an overview diagram illustrating one embodiment of a dual-meter pari-mutuel pool for horse racing, one for tracking bets made on a traditional wagering basis such as win, place, show, exacta, quinella, trifecta and superfecta, for outcomes that are based on the actual results of a race, and a second, hybrid pool based on a mixture of actual and random outcomes, as discussed above.

Figure 14:
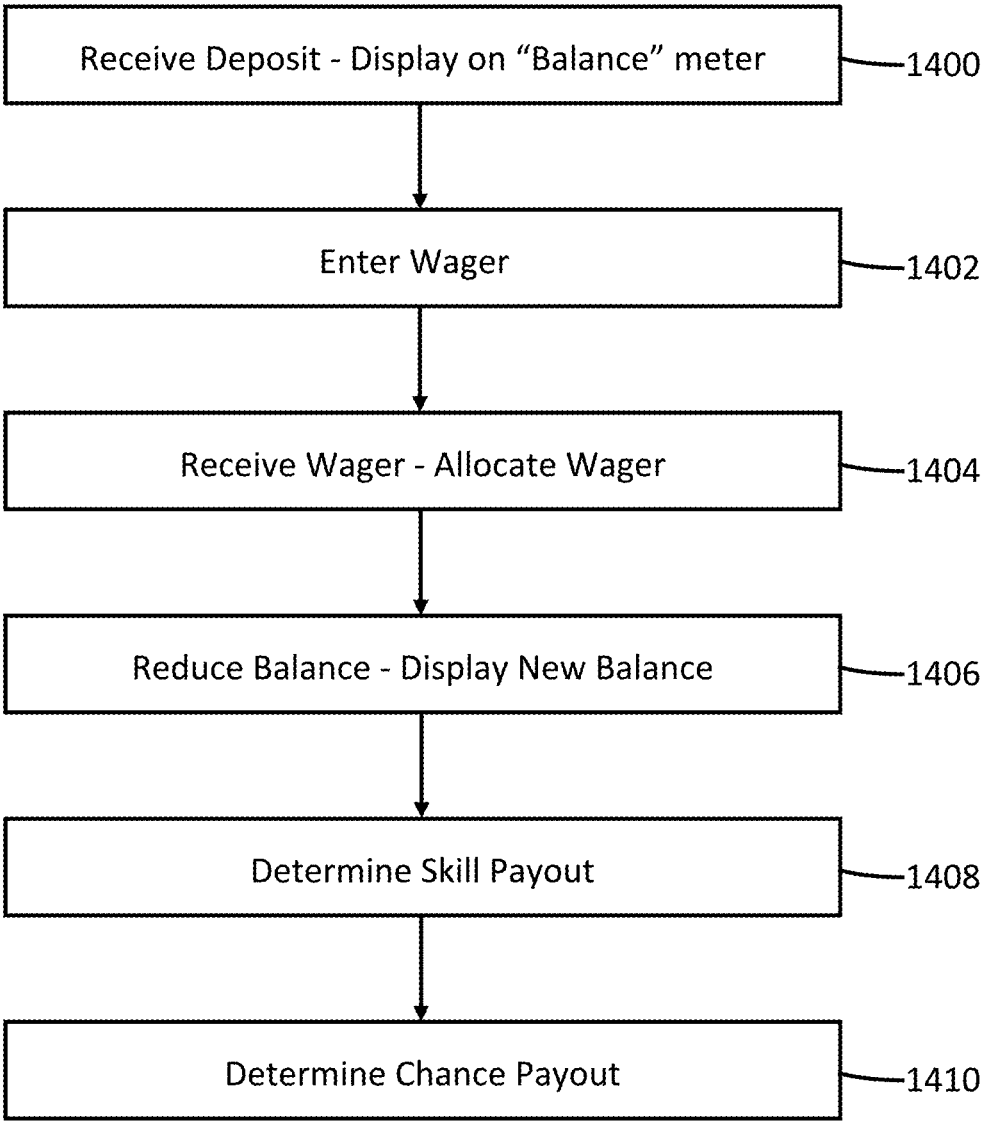
FIG. 14 is a flow diagram illustrating one embodiment of a method for providing an arcade-style video game that offers payouts based on both chance and skill.

FIG. 14 is a flow diagram of one embodiment of an overview diagram of an arcade-style video game that offers payouts based on both chance and skill. The functional components of such an arcade-style video game are as shown in FIG. 3, as a stand-alone game. In another embodiment, some of the functional blocks are located at a central gaming server in an embodiment where the arcade-style video game is networked to the gaming server. For purposes of discussion below, it is assumed that the arcade-style video game is a stand-alone type, with functional blocks as shown in FIG. 3. The arcade-style video game comprises meters 108 through 116, i.e., "Balance", "Wager", "Win-Total", "Win-Chance", and "Win-Skill", as shown in FIG. 1 and FIGS. 6*a*-6*f*.

At block 1400, the arcade-style video game accepts a deposit from a player and displays the deposit as a credit balance. Processor 300 receives the deposit and displays the balance on meter 108. As an example, the player inserts a $10 bill to the machine's bill acceptor (i.e., value exchange mechanism 106), which is displayed by meter 108 as showing $10 as an available credit to the player.

At block 1402, the player starts playing a round of electronic blackjack, for example, by entering a wager into the game, using user interface 104.

At block 1404, processor 300 receives the wager, and allocates a percentage of the wager to chance and the remaining portion to skill, as determined by processor 300 retrieving a skill/chance ratio from memory 302, which in this example indicates that wagers are to be split 60% to skill and the remaining 40% to chance. In the current example, if the wager for one round of play is $1, then the Skill Meter might show 60 cents and the Chance Meter shows 40 cents to indicate how the $1 charge is split between each element of the game. In another embodiment, the $1 wager for playing a round of play might be shown by only one meter (the "wager" meter 110), and in another embodiment, the wager might be split into three meters, one for skill, one for chance and for entertainment, for example 40 cents for skill, 40 cents for chance and 20 cents for the entertainment value of playing the game.

At block 1406, processor 300 reduces the balance by the amount of the wager and displays the new balance via balance meter 108. For example if the player's initial balance was $10, and the player bet $1, then balance meter 108 will show $9, and the wager meter will show $1.

At block 1408, after a round of game play has concluded, processor 300 determines a skill payout if the player played the round in a skillful manner, as determined by processor 300 and explained above. If so, skill meter 116 displays the award made to the player for his or her skills, in this example 60 cents.

At block 1410, processor 300 determines a chance payout if the player won the round, as determined by the particular game being played. In blackjack, the player wins on chance if his final hand is greater than the "dealer's" hand. Processor 300 makes this determination, and if the player beat the dealer, processor 300 awards 40 cents to the player, and causes chance meter 114 to display 40 cents. If the player did not beat the dealer, in this example, processor 300 does not award anything to the player, and chance meter 114 is kept blank or processor 300 causes a zero to be displayed by chance meter 114.

While the foregoing drawings show illustrative embodiments of various embodiments of the invention, it should be noted that various changes and modifications could be made herein without departing from the scope of the embodiments as defined by the appended claims. The functions, steps and/or actions of the claims in accordance with the embodiments of the invention described herein need not be performed in any particular order. Descriptions and abbreviations used herein are provided for ease of discussion only. After reading the description herein, it will become apparent to one of ordinary skill in the art that the present invention can be implemented in any of a number of different computing and networking environments which may include an Electronic Gaming Machine (EGM) such as slots, a virtual game played on a computer, a tablet, a mobile device, etc., whether played locally on the device or played remotely such as on the internet or an intranet network. The features, advantages, and objects of the present invention will become more apparent from the detailed description as set forth below, when taken in conjunction with the drawings.

I claim:

1. A method for determining two or more game payouts in a game based on both skill and chance, comprising:

receiving, by the processor, a wager from a player;

allocating, by the processor, the wager into two components, a skill component based on the player's skill and a chance payout based the random number generator;

determining, by a processor, a skill level of the player as the player plays the game;

determining an outcome of the game;

determining, by the processor, a skill payout based on the skill component and the skill level of the player;

determining, by the processor, a chance payout based on the chance component and the outcome; and providing, by the processor, a first indication of the chance payout and a second indication of the skill payout to a display device for display to the player.

2. The method of claim 1, further comprising:

providing, by the processor, the first indication of the chance payout to a first game meter for display to the player on an electronic display; and providing, by the processor, the second indication of the skill payout to a second game meter for display to the player.

3. The method of claim 1, wherein determining the skill level of the player comprises:

receiving, by the processor, player input from a player input device as the player plays the game;

comparing, by the processor, the player input to one or more exemplary game plays stored in a memory; and determining, by the processor, the skill level of the player based on the comparison of the player input to the one or more exemplary game plays stored in the memory.

4. The method of claim 3, wherein determining the skill level of the player based on the comparison of the player input to the one or more exemplary game plays comprises:

assigning, by the processor, a positive result to the skill level if the player input matches at least one of the one or more exemplary game plays; and assigning, by the processor, a negative result to the skill level if the player input does not match at least one of the one or more exemplary game plays.

5. The method of claim 3, wherein:

the skill payout is increased when the player input matches at least one of the one or more exemplary game plays without affecting the chance payout; and the skill payout is decreased when the player input does not match at least one of the one or more exemplary game plays without affecting the chance payout.

6. The method of claim 3, further comprising:

providing an indication of the skill payout to a skill progressive meter when the player plays the game in accordance with the one or more exemplary game plays stored in the memory a predetermined, consecutive number of times;

adding a second skill component of a second wager to the skill payout when the player does not play the game in accordance with the one or more exemplary game plays stored in the memory; and updating the indication displayed by the skill progressive meter with the second skill component of the second wager.

7. The method of claim 1 , wherein providing the first indication and the second indication to a display comprises:

providing, by the processor via the display device, the indication of the chance payout to a chance meter; and providing, by the processor via the display device, the indication of the skill payout to the skill meter.

8. The method of claim 1, further comprising:

receiving a second wager from a second player of the game;

apportioning, by the processor, the wager and the second wager between a skill pot and a chance pot;

determining a game result between the player and the second player by the processor;

awarding, by the processor, the skill pot to the player who won the game; and awarding, by the processor, at least a portion of the chance pot to any player who finished the game with a predetermined minimum game result.

9. The method of claim 8, further comprising:

determining, by the processor, a second skill level of the second player as the second player plays the game along with the player;

excluding, by the processor, the second player from receiving the at least portion of the chance pot when the second skill level exceeds a predetermined maximum threshold.

10. The method of claim 1, further comprising:

receiving a second wager from a second player of the game;

combining, by the processor, the wager and the second wager into a pot;

determining a game result between the player and the second player by the processor;

determining, by the processor, a first portion of the pot based on skill and a second portion of the pot based on chance;

awarding, by the processor, the first portion of the pot to the player when the game result indicates that the player won the game; and awarding, by the processor, the second portion of the pot to the second player when the second player finished the game with a predetermined minimum game result.

11. The method of claim 10, further comprising:

determining, by the processor, a second skill level of the second player as the second player plays the game along with the player; and excluding, by the processor, the second player from receiving the second portion of the pot when the second skill level exceeds a predetermined maximum threshold.

12. A gaming device for determining two or more game payouts in a game based on both skill and chance, comprising:

a user input device for receiving player input from a player as the player plays the game;

a display for providing visual information to the player as the player plays the game;

a memory for storing processor-executable instructions; and the processor, for executing the processor-executable instructions that cause the gaming device to:

receive, by the processor, a wager from the player;

allocate, by the processor, the wager into two components, a skill component based on the player's skill and a chance payout based the random number generator;

determine a skill level of the player as the player plays the game;

determine an outcome of the game;

determine, by the processor, a skill payout based on the skill component and the skill level of the player;

determine, by the processor, a chance payout based on the chance component and the outcome; and provide, by the processor, a first indication of the chance payout and a second indication of the skill payout to a display device for display to the player.

13. The gaming device of claim 12, wherein the processor-executable instructions further comprise instructions that cause the gaming device to:

provide a first indication of the chance payout to the player via the display; and provide a second indication of the skill payout to the player via the display.

14. The gaming device of claim 12, wherein the instructions that cause the gaming device to determine the skill level of the player comprises instructions that cause the gaming device to:

compare the player input to one or more exemplary game plays stored in the memory; and determine the skill level of the player based on the comparison of the player input to the one or more exemplary game plays stored in the memory.

15. The gaming device of claim 12, wherein the processor-executable instructions further comprise instructions that cause the gaming device to:

receive, by the processor, a second wager from a second player of the game;

combine, by the processor, the wager and the second wager into a pot determine a game result between the player and the second player by the processor;

determine, by the processor, a first portion of the pot based on skill and a second portion of the pot based on chance;

award, by the processor, the first portion of the pot to the player when the game result indicates that the player won the game; and award, by the processor, the second portion of the pot to the second player when the second player finished the game with a predetermined minimum game result.

16. The gaming device of claim 12, wherein the processor-executable instructions further comprise instructions that cause the gaming device to:

provide an indication of the skill payout to a skill progressive meter when the player plays the game in accordance with the one or more exemplary game plays stored in the memory a predetermined, consecutive number of times;

add a second skill component of a second wager to the skill payout when the player does not play the game in accordance with the one or more exemplary game plays stored in the memory; and update the indication displayed by the skill progressive meter with the second skill component of the second wager.

* * * * *